United States Patent [19]

Stoller

[11] Patent Number: 4,941,284

[45] Date of Patent: Jul. 17, 1990

[54] PARKING SPACE BARRIER

[76] Inventor: David Stoller, 904 Winnington Avenue, Ottawa, Ontario, Canada, K2B 5C7

[21] Appl. No.: 451,186

[22] Filed: Dec. 15, 1989

[51] Int. Cl.[5] ..... E05F 13/00

[52] U.S. Cl. ..... 49/49; 49/25; 49/340; 49/343

[58] Field of Search ..... 49/49, 35, 25, 343, 49/340

[56] References Cited

U.S. PATENT DOCUMENTS

| | | | |
|---|---|---|---|
| 2,657,486 | 11/1953 | Sweetser | 49/49 X |
| 3,589,066 | 6/1971 | Fisher | 49/49 X |
| 3,688,439 | 9/1972 | Doxsee | 49/49 X |
| 3,913,264 | 10/1975 | Kohen | 49/49 |
| 4,062,149 | 12/1977 | Collins | 49/49 |
| 4,457,105 | 7/1984 | Danin | 49/49 |
| 4,472,908 | 9/1984 | Wanzl et al. | 49/49 X |
| 4,641,459 | 2/1987 | Mesa | 49/49 X |
| 4,658,543 | 4/1987 | Carr | 49/49 X |
| 4,713,910 | 12/1987 | Quante | 49/49 |

*Primary Examiner*—Philip C. Kannan

[57] ABSTRACT

A parking barrier that is remotely controlled and includes a vertically, pivotally mounted post having an L-shaped arm secured at one end thereof to the post and projecting outwardly therefrom, lying in a generally horizontal plane. The post is positioned at or near one of the boundary lines of a defined parking space and the post may be moved through an arc from one position to another wherein the L-shaped arm, in one position, projects into the parking space preventing unauthorized parties from using that space for parking a vehicle. In the other position, the L-shaped arm overlies two adjoining boundary lines or in proximity thereto, allowing a vehicle to park in the designated space. The pivotally mounted post is mounted on a base that is weighted down by a curb stone so that no modification need be needed to the surface of the parking area. The curb stone is detachably connected (by suitable security devices) to the base plate thereby making the unit itself portable for moving from one site to another. Preferably the apparatus is connected to an electrical power supply through wiring (normally underground) but if need be, a battery can be located in a housing on the base which encloses the post drive mechanism.

14 Claims, 3 Drawing Sheets

PARKING SPACE BARRIER

FIELD OF INVENTION

This invention relates generally to a remote controlled parking space barrier for use in preventing unauthorized use of individual reserved parking spaces and to a parking lot having a plurality of designated parking spaces with a parking space barriers of the present invention selectively controlling access to at least selected ones of designated parking spaces in such parking lot.

BACKGROUND OF INVENTION

Vehicle parking lots are well known having designated spaces defined by curb stones and/or lines on the parking surface. Access to the parking lot is normally controlled by a gate operated by mechanical dispensing of a ticket for parking or insertion of a coded card into the gate controller. Access to in indoor parking lots is normally controlled by a garage door operated either by a key, a coded card or a remote transmitter carried by or operated by those authorized to use the parking area. None of this however provides control of access to individual parking spaces within the parking lot or different designated parking areas of that lot.

There have been a number of prior proposals of user operated parking space barriers as exemplified by the teachings of the following U.S. Pat. Nos: 3,673,734 issued Jul. 4, 1972; 3,698,135 issued Oct. 17, 1972; 3,849,936 issued Nov. 26, 1974; 3,968,596 issued Jul. 13, 1976; 3,061,960 issued Nov. 6, 1962; 3,688,439 issued Sept. 5, 1972; 4,713,910 issued Dec. 22, 1987; 4,762,439 issued Aug. 9, 1988; 4,641,459 issued Feb. 10, 1987; 3,913,264 issued Oct. 21, 1975; 2,657,486 issued Nov. 3, 1953; 4,062,149 issued Dec. 13, 1977; and 4,457,105 issued Jul. 3, 1984.

A shortcoming common to the foregoing proposals is that they are complicated and expensive devices and/or not suitable for both indoor and outdoor use and particularly in outdoor use where during part of the year they are subjected to heavy snow and icing conditions and freezing and thawing conditions.

SUMMARY OF INVENTION

An object of the present invention is to provide an apparatus suitable for indoor and outdoor use, and outdoor use where there is severe weather conditions such as snow, freezing rain and freezing and thawing conditions during part of the year.

A further object of the present invention is to provide apparatus for controlling authorized access to reserved parking spaces in private and/or public parking areas where the apparatus can be simply moved into position and set on top of the parking surface.

A further object of the present invention is to provide a simple mechanical parking space barrier that generally lies along the boundary of the parking space when the parking space is occupied by an authorized user and which projects into the area of the parking space preventing vehicle access thereto when not in use by the authorized user.

In accordance with one aspect of the present invention there is provided in a parking area having defined parking spaces, apparatus preventing unauthorized entry into selected individual ones of such spaces, said apparatus at each selected space comprising a vertical post disposed adjacent a marginal edge of the parking space, a generally L-shaped arm lying substantially in a horizontal plane, means mounting said arm adjacent one end thereof, on said post, means permitting arcuate movement of said arm about the vertical axis of said post from one to the other of two positions where in one position the legs of the L-shaped arm are aligned with two adjoining marginal edges of the parking space allowing use of the space for parking a vehicle and in the other position project into the area between the marginal edges of the parking space forming a barrier preventing a vehicle from parking in such space and means, controlled from a position remote from said apparatus, selectively to cause arcuate movement of the arm from said one position to the other.

In accordance with a further aspect of the present invention there is provided in a parking area having defined parking spaces allocated to authorized users thereof with each having a different designated space and means allowing entry into the respective allocated spaces only by the authorized user's thereof, said means at each allocated space comprising an L-shaped arm pivotally mounted for movement about a vertical axis and moveable from one to the other of first and second positions where in the first position the arm projects into the parking space preventing entry of a vehicle thereinto and in the other position lies along a portion of the perimeter of the designated parking space.

LIST OF DRAWINGS

The invention is illustrated by way of example in the accompanying drawings, wherein.

Description of Preferred Embodiment

Figure 1:
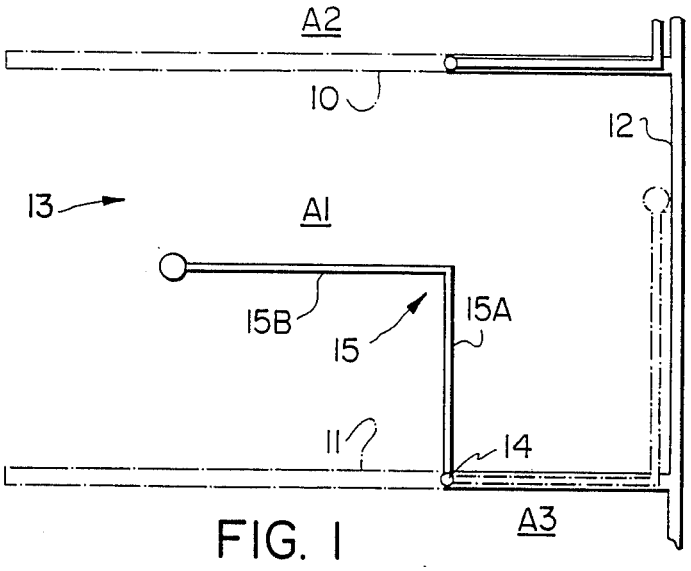
FIG. 1 is a top plan view of a designated parking space employing a parking space barrier in accordance with the present invention.
Figure 2:
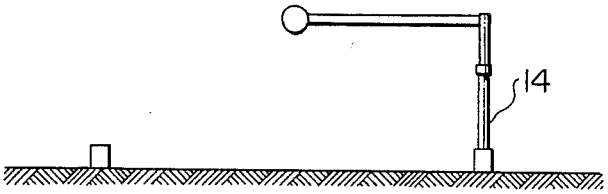
FIG. 2 is a front elevational view of FIG. 1.

Referring to the drawings, illustrated in plan view in FIG. 1 is one parking space designated A1 between parking spaces A2, A3, in a series of side-by-side designated parking spaces in a parking area which may be public, private or otherwise. The designated area A1 has parallel side boundary lines 10 and 11 and a front boundary line 12 positively defined as by, for example, lines painted on the parking surface or tape applied to the parking surface or curb stone mounted on the parking surface or combinations thereof. Entry into the parking space is through the non-marked entry space designated 13.

In the embodiment illustrated in FIG. 1, boundary lines 10 and 11 have a major portion thereof painted on the surface and a minor portion of curb stone, one such minor portion extending approximately four feet back from the front boundary line 12 of the parking space.

Figure 3:
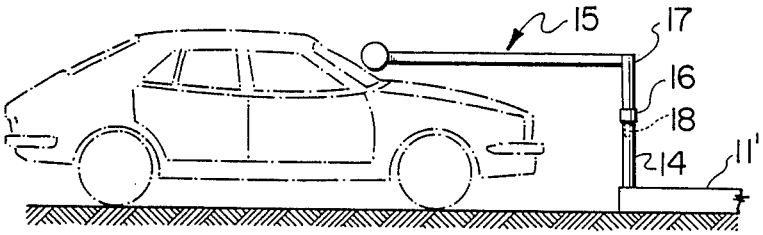
FIG. 3 is a right hand side elevational view of FIG. 1.

The parking space barrier of the present invention includes a vertical post located on or near a boundary of a defined (or in part defines) parking space and an L-shaped arm secured to and projecting from the post. In the embodiment of FIG. 1, vertical post 14 is located on the side boundary line 11 of the parking space at a position spaced rearwardly from the front boundary line 12. The post may be either mounted in the parking surface or in the curb stone 11' as illustrated in FIG. 3. An L-shaped, in plan view, arm 15 having respective portions 15A and 15B is pivotally mounted as at 16 on post 14 by a stub shaft 17 or by post 14 for movement in a selected arc about a vertical axis. Alternatively the post can be pivotally mounted as will be seen hereinafter.

A motor drive means 18 is located in the post (or mounted on shaft 17) for causing rotation of the shaft 17 on the post selectively to position the L-shaped arm in one or the other of two different positions where in one position, shown in broken line in FIG. 1, the arms overlie the boundary lines permitting parking in the designated parking space or in the other position, shown in solid line, project into the parking area preventing access thereto. In the embodiment illustrated in FIG. 1, arm 15A in one position overlies the boundary line 11 while the arm 15B is parallel to and closely adjacent or overlies the parking space boundary line 12 and in the other position arm 15A projects out into the parking space while arm 15B extends toward an oncoming vehicle (see also FIG. 3) preventing such vehicle from completely entering the parking space.

The motor drive means 18 is remotely controlled by the motor vehicle operator having in his possession a transmitter of say a remote control garage door type.

Figure 4:
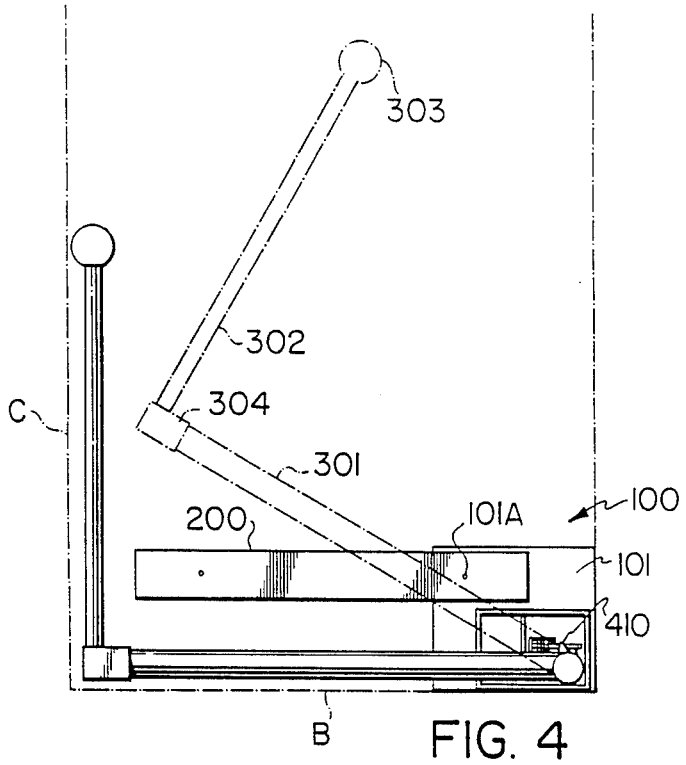
FIG. 4 is a top plan view of a particular mechanical device to provide parking space controlled access in accordance with the present invention.
Figure 5:
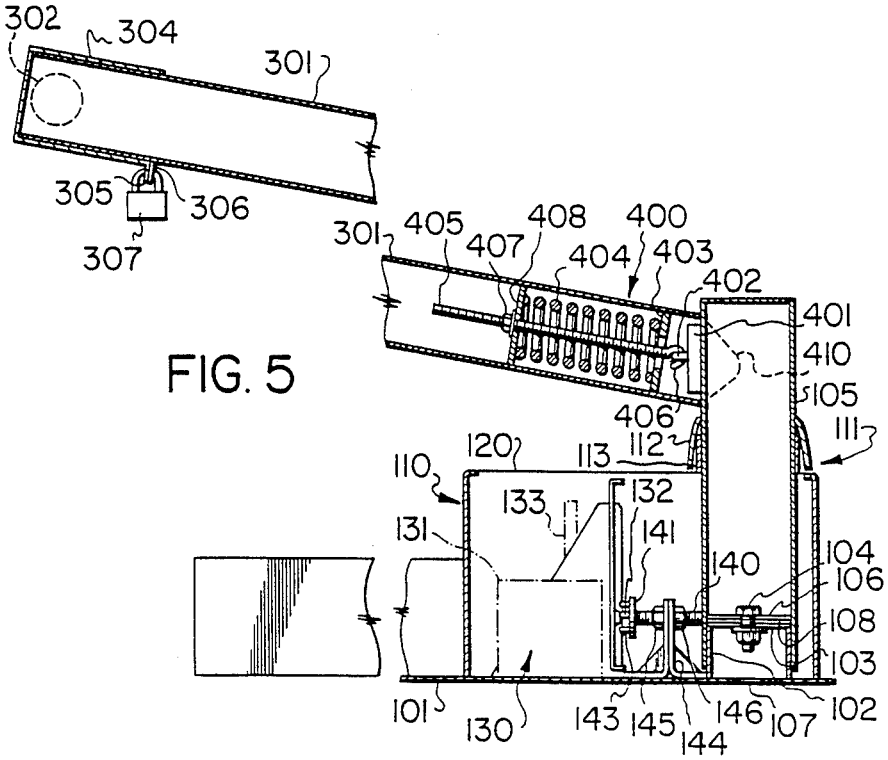
FIG. 5 is an elevational, partial sectional, view of FIG. 4.
Figure 6:
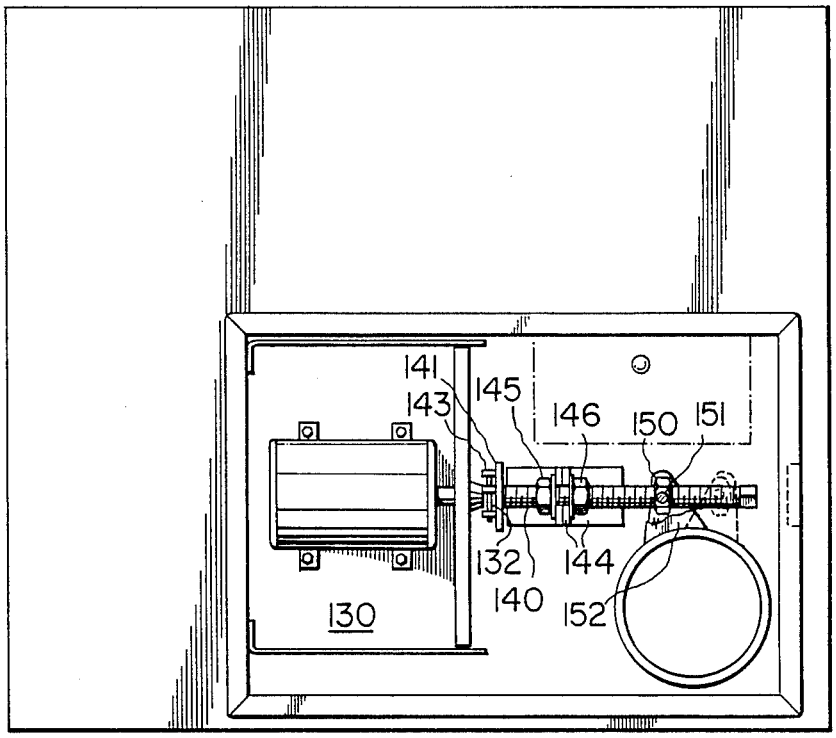
FIG. 6 is a top plan view of a portion of the apparatus of FIGS. 4 and 5 with parts removed and on a larger scale for clarity of illustrating.

Details of one particular parking space control device 100, provided in accordance with the present invention, is illustrated in FIGS. 4, 5 and 6. Referring to these Figures, illustrated is a base plate 101 attachable as by a bolt and nut or other means 101A to a curb stone 200 or other suitable weight. A portion of the base plate underlies part of the curb stone with access to the interconnecting bolt being preferably from the underside of the base plate. Since the curb stone normally would be of a weight too heavy for an individual or individuals to move, it is difficult if not impossible for vandals or non-authorized users to move the device away from the parking space blocking position. The assembly illustrated in FIGS. 4, 5 and 6 rests on the ground without attachment thereto, requiring no modification to the parking lot other than electrical wiring for powering the motor to move the arm. The curb stone weight being detachably connected (by any suitable security operative means), gives portability to the device for movement when desired or required from one site to another.

Mounted on the base 101 is a stub post 102 having an upper end plate 103 aperture to receive a bolt 104. A post 105 has a recess in the bottom end thereof for receiving the stub post 102 and likewise has a baffle plate 106 therein to which a bolt 104 is securely anchored. A hole 107 in the base plate, aligned with the bolt, provides access of a socket wrench on the end of a shaft for threading a nut onto the bolt and tighten the same. Nylon or the like, friction reducing bearing plates or washers 108 is interposed between the plates 103 and 106.

A housing 110 is secured to the base plate, providing an enclosure for a drive mechanism to rotate the post through a selected arc and the upper wall of such enclosure provides a bearing support 111 for the post 105 which projects upwardly beyond the housing. The bearing support 111 is weatherproofed for outdoor use and includes for example, an annular shield 112 secured to and having a portion on the lower part, spaced from the post, to receive therebetween a flange (or spigot) 113 projecting upwardly from the upper wall of the housing 110.

The upper wall of the housing 110 has a removable cover portion 120 attached by suitable tamper proof means, allowing access into the interior of the housing only by authorized workman, should repair be necessary on site.

Mounted on the base 101, within the enclosure 110, is a conventional garage door opener electric motor and control board unit, all of which is generally designated by the numeral 130. The unit for example, may be a conventional Stanley Tool Company ⅓ H.P. garage door opener, operatively controlled by a remote hand-held unit. The power unit 130 has an electric motor 131, driving an output gear 132 by way of a speed reduction unit. A programmed controller board 133, located in the unit causes actuation of the motor 130 from wireless signals received from a hand-held transmitter carried by the authorized parking space user. The gear 132 drives a threaded shaft 140 by way of a coupling 141 secured to the shaft and which has a plurality of pins 143 projecting from the face thereof into spaces between the teeth on the gear. The threaded shaft 140 is journaled for rotation on a support 144 and is prevented from axial displacement by stops 145 and 146 in the form of nuts secured to the shaft and located respectively on opposite sides of the support bracket 144. A nut 150 is threaded onto the shaft and connected by way of pins 151 to a bracket member 152, secured to and projecting from the post 105. The nut 150 has a pair of pins 151 projecting from opposite faces thereof into aligned apertures in a pair of spaced apart bracket members 152. As the threaded rod is rotated, the nut 150 travels along the rod, causing the post 105 to rotate about the vertical axis. The post travels through an arc in normal operation of about 30°. The pins 151 pivotally mount the nut on the bracket. The plate 141 and pins 143 form a loose coupling with the gear allowing for changes in alignment that take place due to arcuate movement of the bracket 152.

By way of example, the shaft 140 may be rotated at about 100 rpm on a shaft having 10 ten threads per inch and this moves the barrier arm into and out of the parking space blocking position, at about the same rate as a garage door opens. Obviously changes in the speed of operation can be modified to suit the requirements of the user.

The parking space barrier shown in broken line in one position FIG. 4 and in solid line in another position in the elevational view in FIG. 5, consists of two detachably interconnected arms designated respectively 301 and 302. The arm 302 can, if desired, have upon the outer free end thereof, a display or sign board 303 which can be in the form of a plate, multi-faceted block or sphere. The arm 302, at the opposite end, is attached to a sleeve 304 which telescopes over the end of the arm 301. The sleeve 304 has an apertured lug 305, alignable with a first lug 306, secured to the arm 301 for receiving a locking device 307 to hold the arm 302 in a normal horizontal barrier operative position. A second lug on the arm 301 can be positioned spaced circumferentially around the arm 301 from the lug 306, so as to hold arm 302 at a generally vertical position, as may be required for snow removal when used in outdoor parking areas. The arms 301 and 302 are tubular members, with arm 302 being of smaller diameter, reducing the weight while at the same time, permitting inserting arm 302 into arm 301 for packaging and shipping purposes.

The arm 301 is attached to the vertical post 105 by a spring loaded breakaway, generally designated by the reference numeral 400. The breakaway is designed to prevent damage which may be caused by vandals or others sitting and/or jumping on the barrier arms 301 and/or 302. The coupling 400 includes an arm centering plug 401 attached to the post 105 and which projects into the open end of the arm 301. On the outer end of the plug 401 is a lug 402. Secured to the inside of the arm 301, at a position spaced inwardly from the end of the arm, is an apertured plate 403 that provides an abutment for a compression coil spring 404. A bolt 405, with an open eye end 406, extends through the coil spring and hooks onto the loop 402. The bolt has a nut 407, threaded thereon that abuts against a washer 408 that bears against the coil spring. The spring is pre-compressed to the extent that the arm will give by compressing the spring, before damage occurs to either the arm or the post in the event abnormal forces are applied to the barrier arm either by vandals or by a motorist. This allows the arm 301 to move up and down as viewed in FIG. 5 or in an arcuate path to the left and right as viewed in FIG. 4. The spring coupling also allows the arm 301 to rotate about its longitudinal axis which can be caused by moving the arm 302, either down toward the ground or in a direction upwardly therefrom. This rotational movement is resisted by effectively a camming action at the end of the arm 301 in abutment with the post. The end of the arm 301 has a concave shaped end 410 conforming, in top plan view, to the outer surface of the circular post 105. Any attempt to rotate the arm 301 about its longitudinal axis, causes such arm to move outwardly from the post 105 against which it abuts and such movement is counteracted by the preloading of spring 404. This preloading is normally such that it is impossible for a person to apply sufficient force upon the end of arm 302 to move such arm out of a parking space obstructing position.

In FIG. 4, the arms 301 and 302, at right angles to one another, are shown in two different positions. In one position, both arms 301 and 302 project into the parking space area, designated A5. In this position, non-authorized persons are prevented from parking their vehicle in the designated space. An authorized user for such space, through the use of a remote control unit, will activate the motor 130, causing the arms to swing to a second non-obstructing position in which arm 301 is near the front boundary line B of the parking space and arm 302 is near the parking space side boundary line designated C. The curb stone 200 is between the boundary line B and the vehicle that would be parked in such designated area, adding a little to the depth of the parking space required as opposed to the embodiment illustrated in FIG. 1.

The embodiment illustrated in plan view in FIG. 4 is intended primarily for outdoor use where it is necessary to clear snow from the parking area. To clear the parking area, the arms 301 and 302 would be in the second foregoing described position and lock 307 would have to be removed, allowing arm 302 to be pivoted to a vertical position. The lock can be used connecting lug 305 and the second lug (not shown) on arm 301 to hold the arm 302 in an upright (or generally upright) position.

The foregoing apparatus is described with reference to having available electrical power and wired into the designated parking spaces and which can be connected to the electric motor driving the vertical post. Should power not be available, a battery or batteries can be located in the housing, having the motor drive mechanism located therein. An LED or the like can be mounted in a position visible to the user of the space as early warning of the battery approaching low charge and in need of charge. Should, however, the power drive in either instance fail, a mechanical back-up may be provided. For this purpose, the housing is provided with a security locked aperture aligned with the end of the threaded shaft 140. The end of the shaft, having the threads thereon, can be shaped so as to for example, conform to a conventional tire wrench. In the event of a power failure, one need only unlock the access opening and insert the wrench end portion of the tire wrench through the aperture and engage the shaped end of the shaft, mechanically turning it to move the barrier to a desired position.

I claim:

1. In a parking area having defined parking spaces, apparatus preventing unauthorized entry into selected individual ones of such spaces, said apparatus at each selected space comprising a vertical post disposed adjacent a marginal edge of the parking space, a generally L-shaped arm lying substantially in a horizontal plane, means mounting said arm adjacent one end thereof, on said post, means permitting arcuate movement of said arm about the vertical axis of said post from one to the other of two positions where in one position the legs of the L-shaped arm are aligned with two adjoining marginal edges of the parking space allowing use of the space for parking a vehicle and in the other position project into the area between the marginal edges of the parking space forming a barrier preventing a vehicle from parking in such space and means, controlled from a position remote from said apparatus selectively to cause arcuate movement of the arm from said one position to the other.

2. The apparatus of claim 1 wherein the L-shaped arm is removably mounted on said post and means permitting only authorized removal of the arm from such post.

3. The apparatus of claim 1 wherein said post is removably mounted in a socket in the ground.

4. The apparatus as defined in claim 1 wherein said post is mounted in a curb stone or has a curb stone resting on a base to which the post is attached.

5. An apparatus as defined in claim 1 wherein said arm is connected to said post by a spring loaded breakaway coupling.

6. The apparatus of claim 5 wherein the spring of said spring loaded coupling resists movement of the arm relative to the post including rotation, about the axis of the arm attached to the post.

7. The apparatus of claim 6 wherein preloading of the spring is selectively adjustably variable.

8. In a parking area having defined parking spaces allocated to authorized users thereof with each having a different designated space and means allowing entry into the respective allocated spaces only by the authorized user's thereof, said means at each allocated space comprising an L-shaped arm pivotally mounted for movement about a vertical axis and moveable from one to the other of first and second positions where in the first position the arm projects into the parking space preventing entry of a vehicle thereinto and in the other position lies along a portion of the perimeter of the designated parking space.

9. Apparatus mountable in proximity to a marginal edge of a defined parking space preventing unauthorized entry of a vehicle into such parking space, said apparatus comprising a base, a vertical post mounted on said base and movable about the vertical axis of the post through a selected arc, a generally L-shaped arm normally disposed in a substantially horizontal plane and connected at one end thereof to said post, arcuate movement of the post being such that in one position the legs of the L-shaped arm are aligned with two adjoining marginal edges of the defined parking space allowing use of the space for parking a vehicle therein and in the other position project into the area between the marginal edges of the parking space forming a barrier preventing a vehicle from parking in such space, spring loaded breakaway means at said post operative to prevent damage to said post and/or L-shaped arm as a result of abnormal forces applied thereto and means controlled from a position remote from said apparatus selectively to cause movement of said L-shaped arm from said one position to the other.

10. Apparatus as defined in claim 9 including a housing on said base enclosing power drive means connected to the post for pivoting the same and wherein said base has a portion projecting beyond said housing which underlies weight means used to hold the apparatus at a selected site.

11. Apparatus as defined in claim 10 wherein said projecting base portion is detachably connectable by security means to the weight.

12. Apparatus as defined in claim 10 wherein said drive means includes a power driven screw means.

13. Apparatus as defined in claim 9 wherein said breakaway means connects one end of the L-shaped arm to said vertical post.

14. Apparatus as defined in claim 13 wherein said one end of the L-shaped arm is concave partially extending around the post and providing a cam resulting in a force resisted by the spring, when the arm extending from the post is rotated about its axis.

* * * * *